US008020543B2

(12) United States Patent
Maleski et al.

(10) Patent No.: US 8,020,543 B2
(45) Date of Patent: Sep. 20, 2011

(54) CROSSBOW DRY FIRE ARRESTOR

(75) Inventors: Richard Maleski, Plymouth, CT (US); Carl Wilber, Morris, CT (US); Kenneth Mieczkowski, Sweet Valley, PA (US)

(73) Assignee: Falcon Outdoors, LLC, Secaucus, NJ (US)

( * ) Notice: Subject to any disclaimer, the term of this patent is extended or adjusted under 35 U.S.C. 154(b) by 667 days.

(21) Appl. No.: 12/016,565

(22) Filed: Jan. 18, 2008

(65) Prior Publication Data

US 2008/0202487 A1 Aug. 28, 2008

Related U.S. Application Data

(60) Provisional application No. 60/881,076, filed on Jan. 18, 2007.

(51) Int. Cl.
*F41B 5/12* (2006.01)

(52) U.S. Cl. ..... 124/25; 124/40

(58) Field of Classification Search ..... 124/25, 124/40

See application file for complete search history.

(56) References Cited

U.S. PATENT DOCUMENTS 5,085,200 A * 2/1992 Horton-Corcoran et al. ... 124/25
6,205,990 B1 * 3/2001 Adkins ..... 124/25
6,736,123 B1 * 5/2004 Summers et al. ..... 124/25
6,802,304 B1 * 10/2004 Chang ..... 124/25

* cited by examiner

*Primary Examiner* — John Ricci
(74) *Attorney, Agent, or Firm* — Luedeka, Neely & Graham, PC

(57) ABSTRACT

Disclosed in a dry fire arrestor for a crossbow having a trigger mechanism operable to fire an arrow or bolt, that includes a spring plate, trigger sear connected to the trigger mechanism, an anti-dry fire bar for engaging and disengaging the trigger sear. The dry fire arrestor utilizes tension provided by the spring plate to allows anti dry fire bar to automatically engage the trigger sear, precluding movement of the trigger when an arrow in not properly inserted in the dry fire arrestor.

21 Claims, 16 Drawing Sheets

CROSSBOW DRY FIRE ARRESTOR

This application claims priority to provisional application Ser. No. 60/881,076, filed with the U.S. Patent and Trademark Office on Jan. 18, 2007, the contents of which are incorporated herein by reference.

BACKGROUND OF THE INVENTION

1. Field of Invention

The present invention relates generally to crossbows, and in particular to trigger mechanisms for preventing firing of a crossbow without a bolt loaded therein.

2. Description of the Related Art

Crossbows have been used since the Middle Ages. Crossbows have evolved to include cams and synthetic split limbs that greatly increase firing velocity. However, increased firing velocity creates a problem of damage or injury when the crossbow is inadvertently fired when unloaded, i.e. when the crossbow is discharged without a bolt (also referred to as an arrow) that is loaded, i.e. pressed against the tensioned crossbow string. Unloaded or dry firing impacts can damage the crossbow string, limbs, cams and other components. Dry firing also creates a safety concern. Further, the time required to reload a dry fired crossbow will often allow quarry to escape, which is a significant concern for crossbow hunters.

In an attempt to overcome such problems, a dry fire inhibitor has been introduced in the form of a hinge lever or finger positioned along the crossbow barrel near the start of the string travel. The hinge lever is configured to normally contact the barrel, and insertion of an arrow creates a separation between the hinge lever and the barrel. When dry fired, the string will travel a short distance and then the finger will catch the string, akin to the operation of an aircraft carrier tail hook arrestor.

Conventional dry fire inhibitors fail to ensure proper loading of an arrow or bolt into the trigger mechanism and fail ensure that the arrow is properly nestled against the tensioned crossbow string. Discharge when an arrow is not properly nestled against the tensioned string can result in the string becoming jammed beneath the incorrectly loaded arrow. In addition, conventional dry fire inhibitors may ride along the arrow as the arrow is discharged, reducing crossbow accuracy.

The present invention provides an arrestor that solves the problems associated with conventional crossbow dry sore inhibitors.

SUMMARY OF THE INVENTION

The present invention overcomes disadvantages of conventional systems by providing a self-contained dry fire arrestor that includes a dry fire member and a spring which holds the dry fire member in engagement with a trigger mechanism to prevent firing the crossbow unless an arrow or bolt is loaded in the crossbow.

The present invention provides an advantage of an automatic safety feature by immobilizing the crossbow trigger when an arrow or bolt is not properly loaded.

The present invention provides a further advantage of precluding any string travel absent proper loading of an arrow.

The present invention provides yet a further advantage of avoiding misfires and jamming.

The present invention is lightweight, reliable and can be incorporated into the trigger mechanism.

The dry fire arrestor of the present invention can, if desired, be combined with the above-described conventional dry fire inhibitors.

BRIEF DESCRIPTION OF THE DRAWINGS

For a better understanding of the invention as well as other objects and further features thereof, reference is made to the following detailed description to be read in conjunction with the accompanying drawings, wherein.

DETAILED DESCRIPTION OF THE PREFERRED EMBODIMENTS

Figure 1:
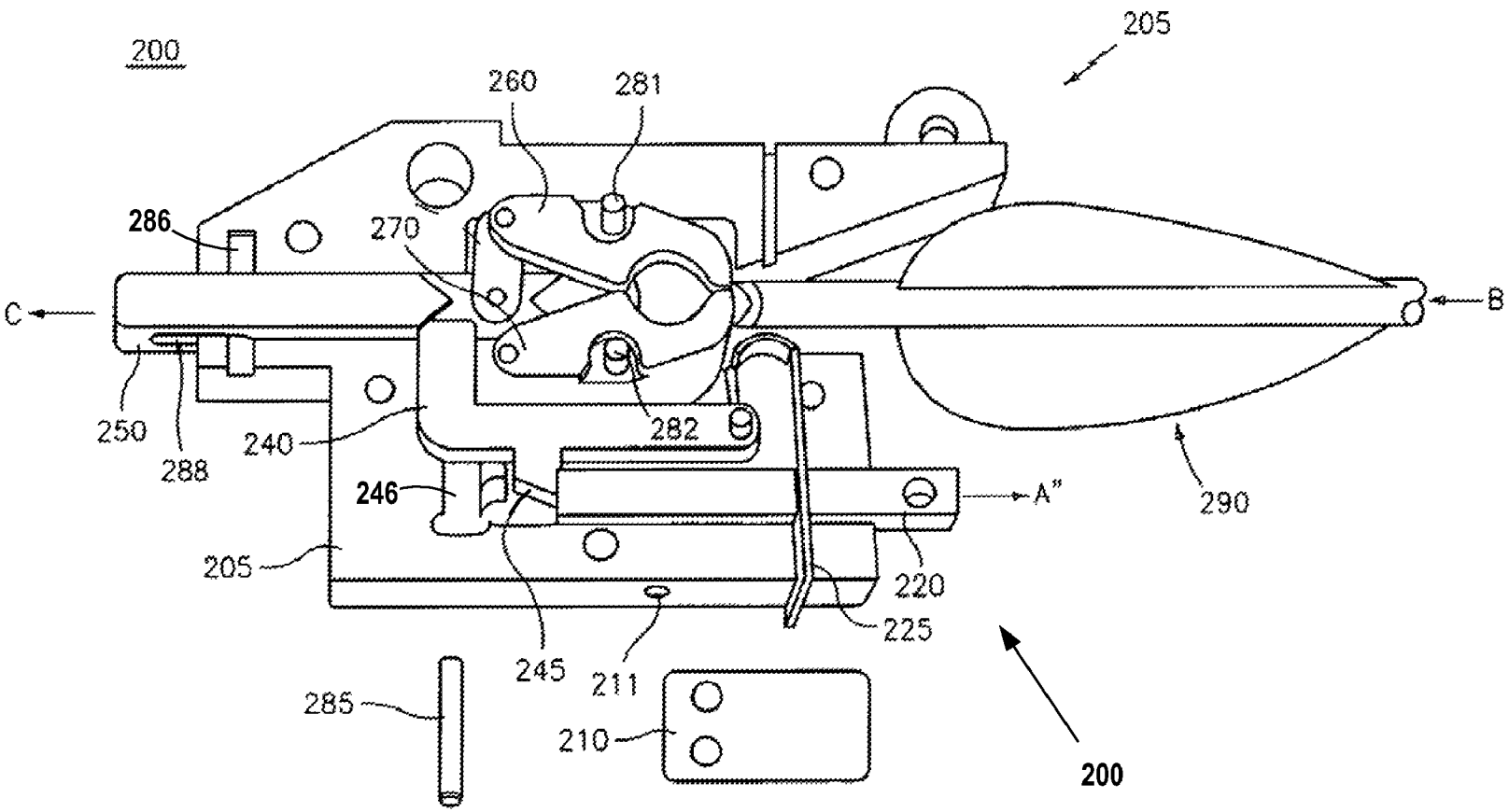
FIG. 1 is a cutaway view of the crossbow dry fire arrestor of the invention, in a cocked engagement position.

The following detailed description of the preferred embodiment of the invention will be made in reference to the accompanying drawings. In describing the invention, explanation about related functions or constructions known in the art are omitted for the sake of clarity in understanding the concept of the invention, as such would obscure the invention with unnecessary detail.

As shown in FIGS. 13-16 crossbow 100 includes stock 110, barrel 120, dry fire arrestor 200, telescopic sight 150 and sight mount 140 which secures the sight on arrestor 200. The crossbow 100 has limbs 160 and string 170.

Figure 8:
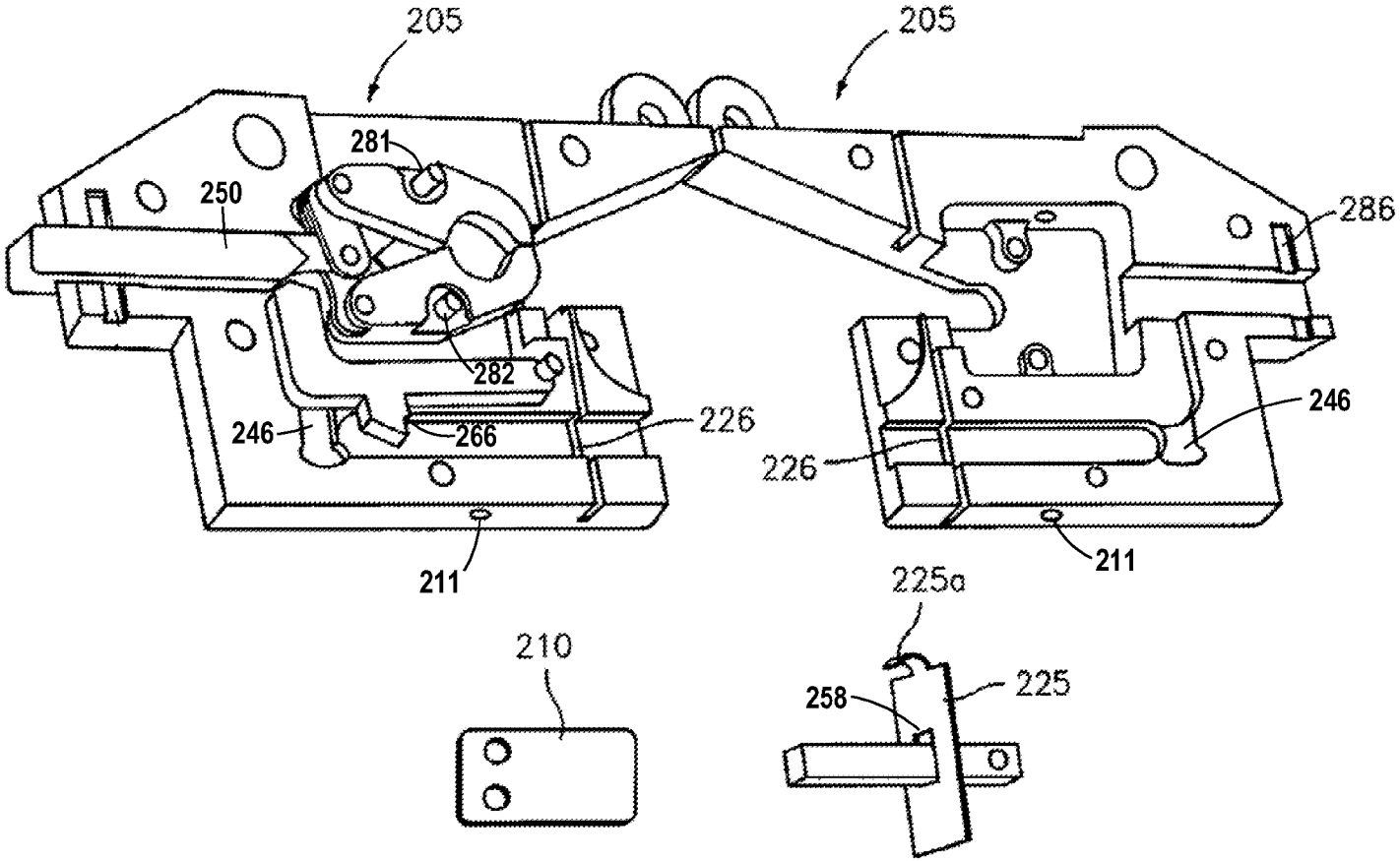
FIG. 8 is a disassembled view showing both halves of the casing of the dry fire arrestor.

FIG. 1 provides a cutaway view of the crossbow dry fire arrestor 200 in an engagement, i.e. cocked position, with a tensioned crossbow string (not shown) held between closed upper and lower jaws 260, 270 awaiting firing of the crossbow. Upper and lower jaws 260, 270 are shown in an open position in FIG. 12 and are shown in a closed (or cocked) position in FIGS. 1, 6 and 8.

Figure 9:
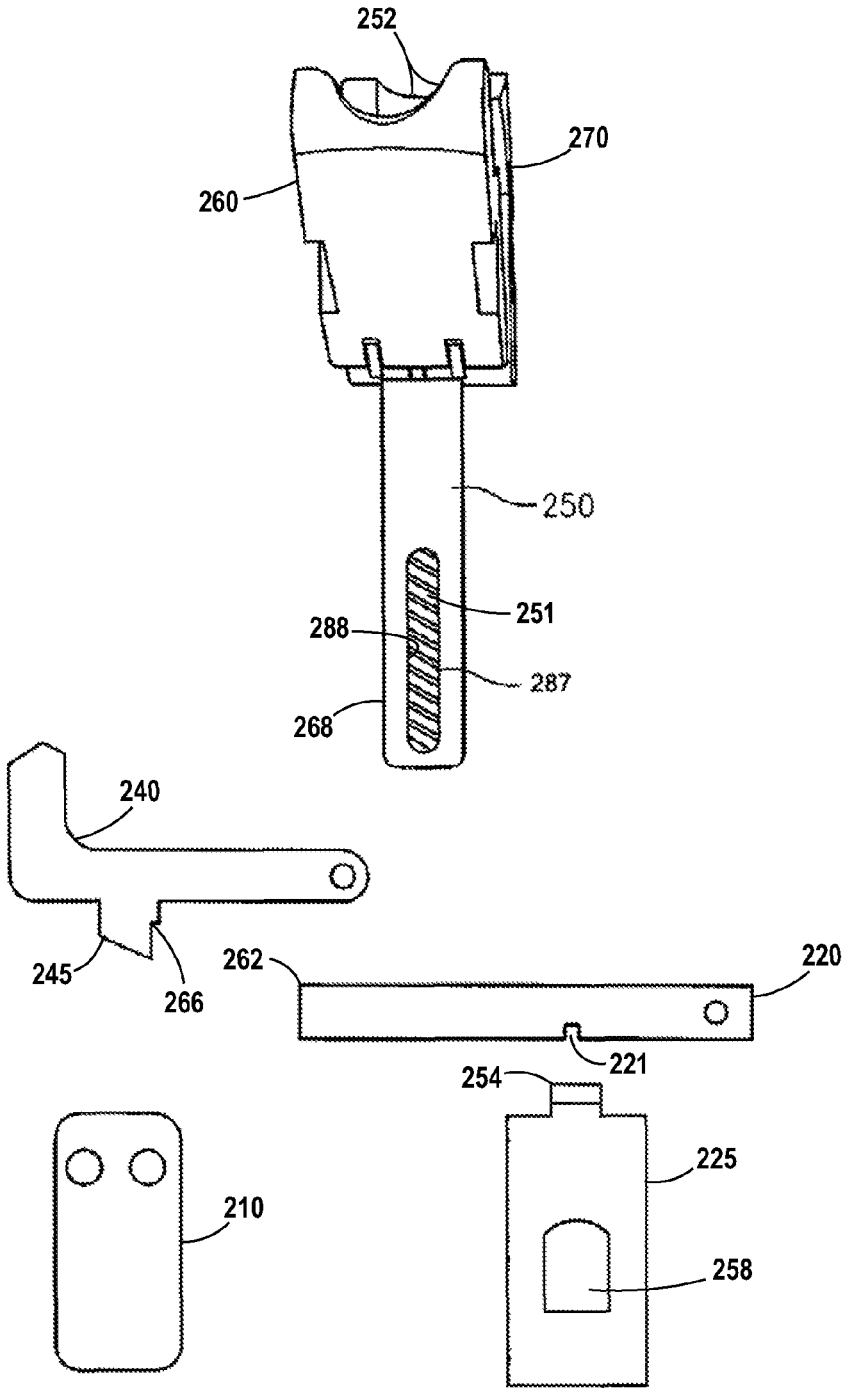
FIG. 9 is a top view of the jaws, showing a jaw urging member and jaw member slot and other components.

Arrow 290 is shown being inserted between the jaws in direction "B" in FIG. 1. As shown in FIG. 9, an opening 252 is provided at the center of each of upper and lower jaws 260, 270 through which arrow 290 is held. It is preferable to provide both upper and lower jaws 260, 270 to hold the crossbow string at a position that is not in contact with the barrel 120 of the crossbow 100, thereby reducing string wear and improving firing accuracy. In contrast, conventional crossbow string holders utilize a single action gate that presses the string against the barrel 120.

An upper curved portion 254 of anti-dry fire bar or member 225 is preferably provided to allow for frictional contact to hold arrow 290 in the dry fire arrestor 200.

Figure 2:
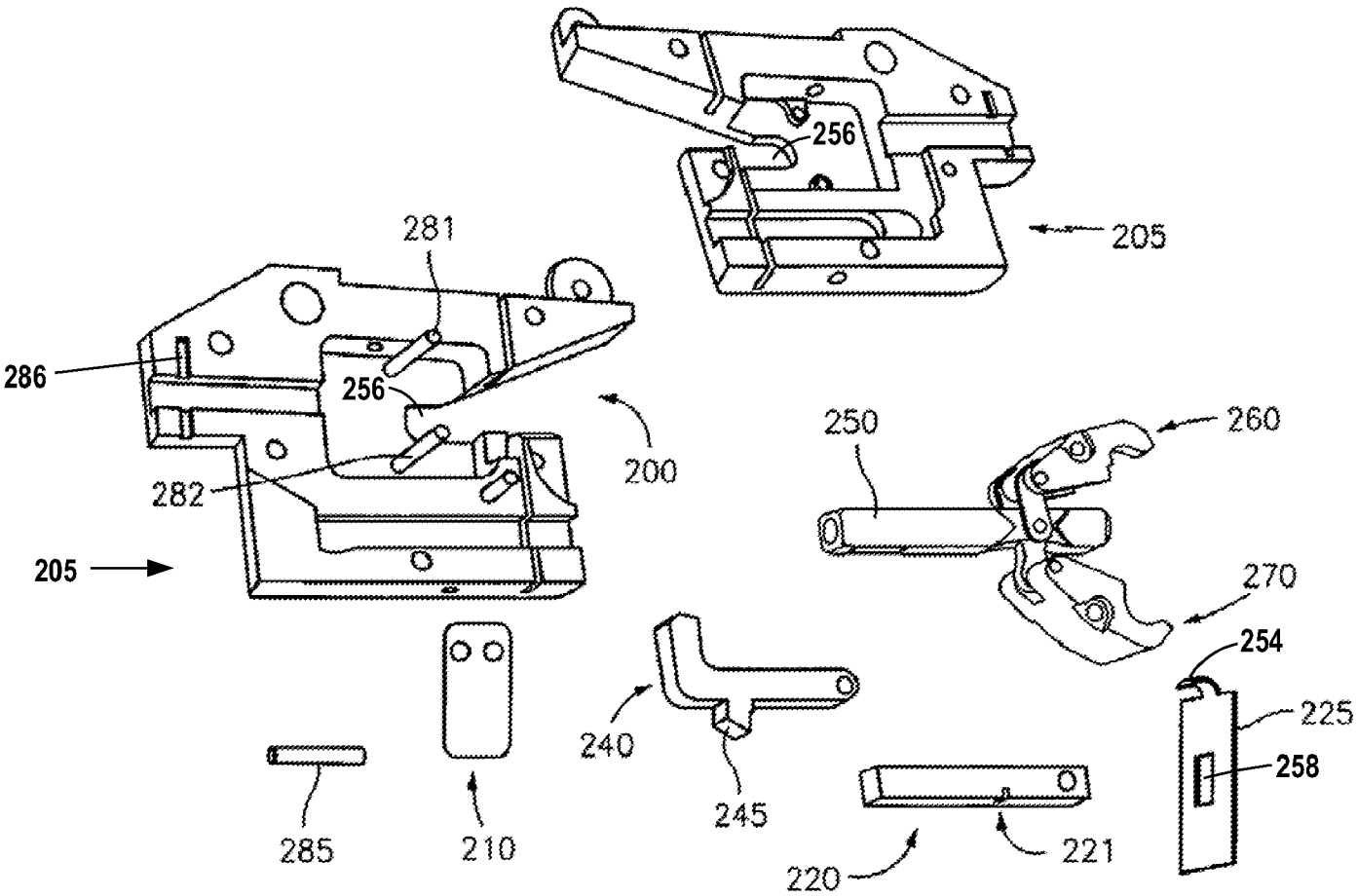
FIG. 2 is a disassembled view of the crossbow dry rare arrestor of FIG. 1.
Figure 5:
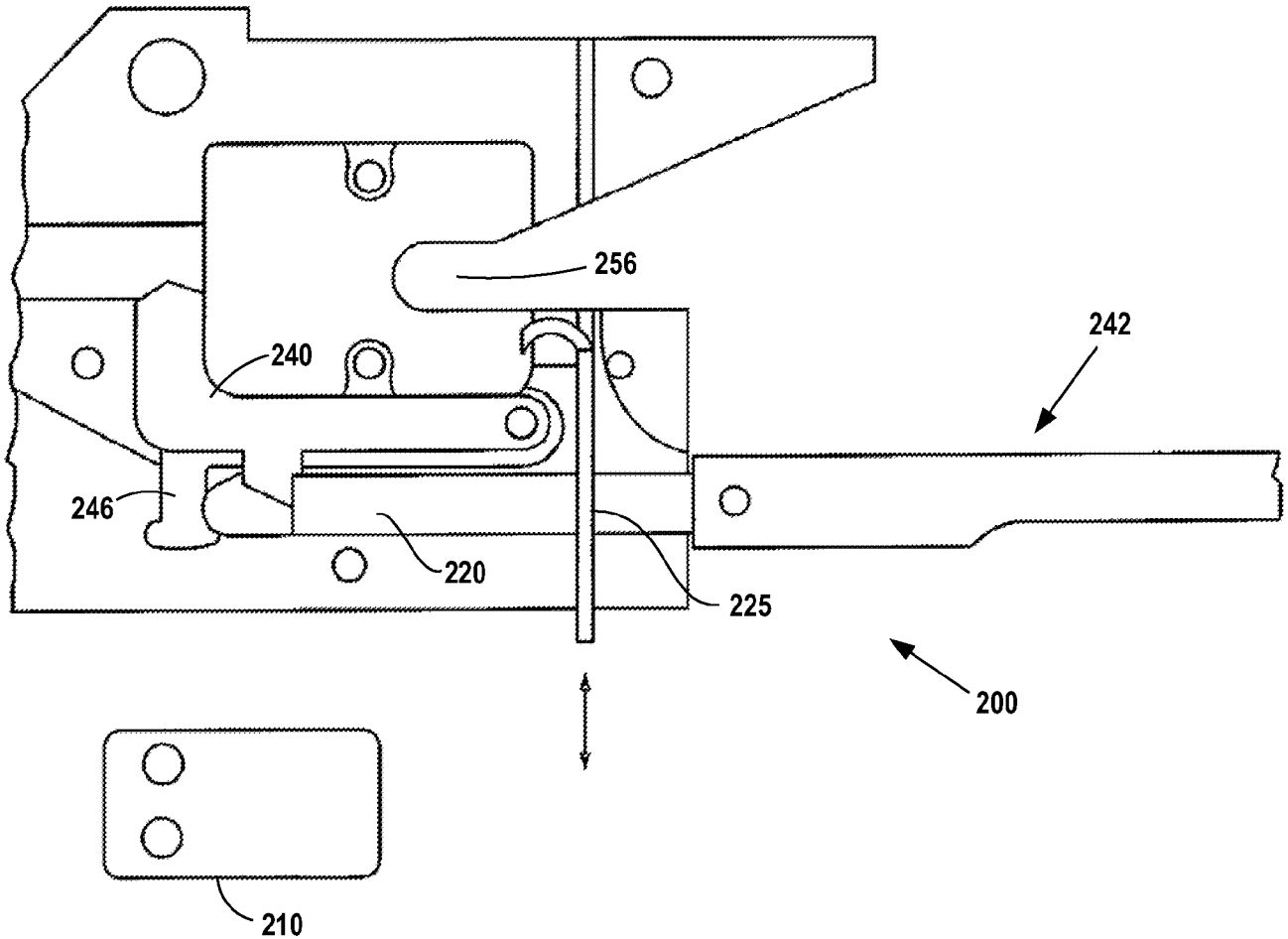
FIG. 5 is a cutaway view of the crossbow dry fire arrestor of FIG. 1, showing movement directions of an anti-dry fire bar.
Figure 7:
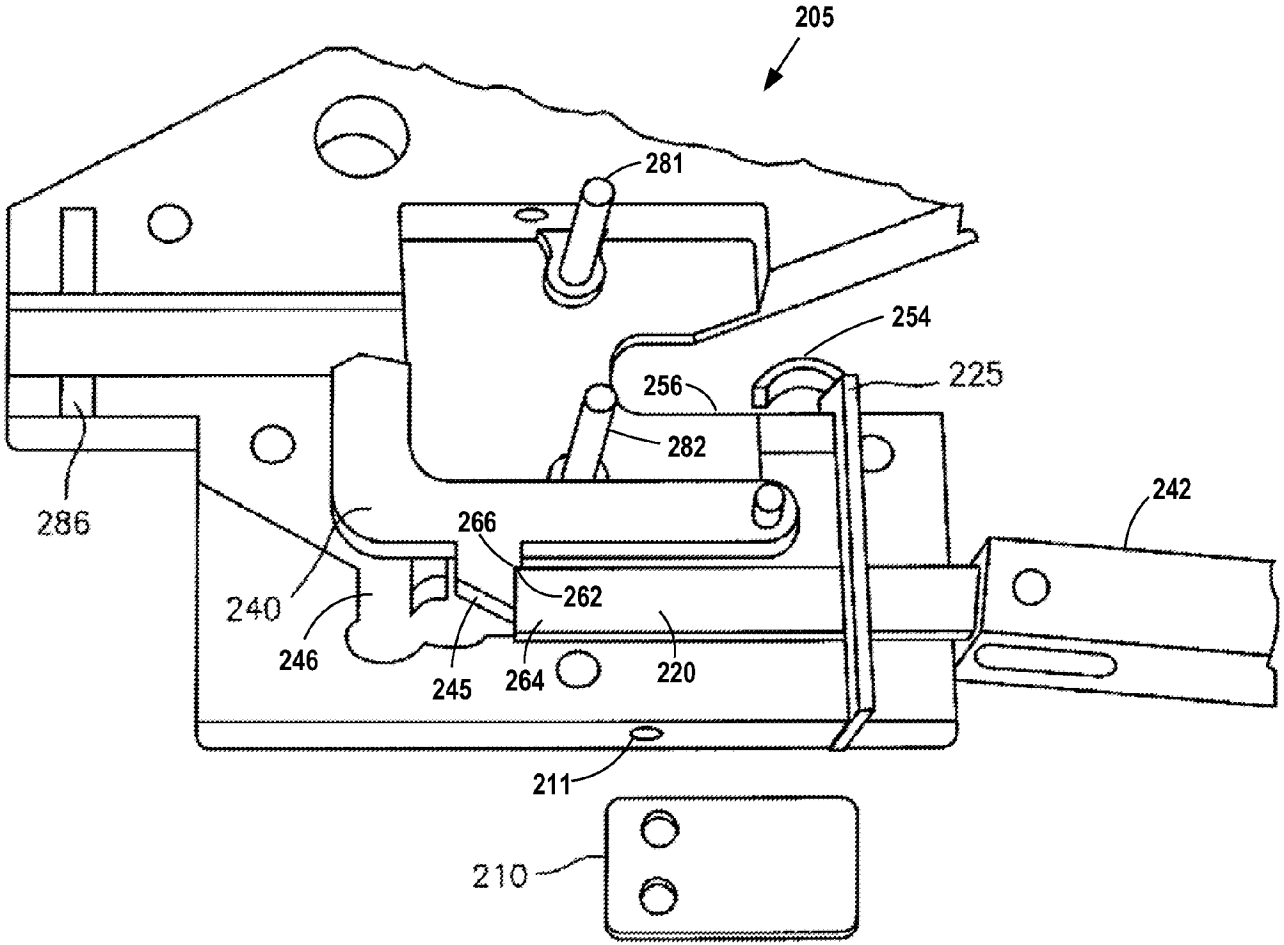
FIG. 7 is a disassembled view of the crossbow dry fire arrestor of FIG. 1, showing engagement of the trigger sear with a shoulder region of an engaging member.
Figure 16:
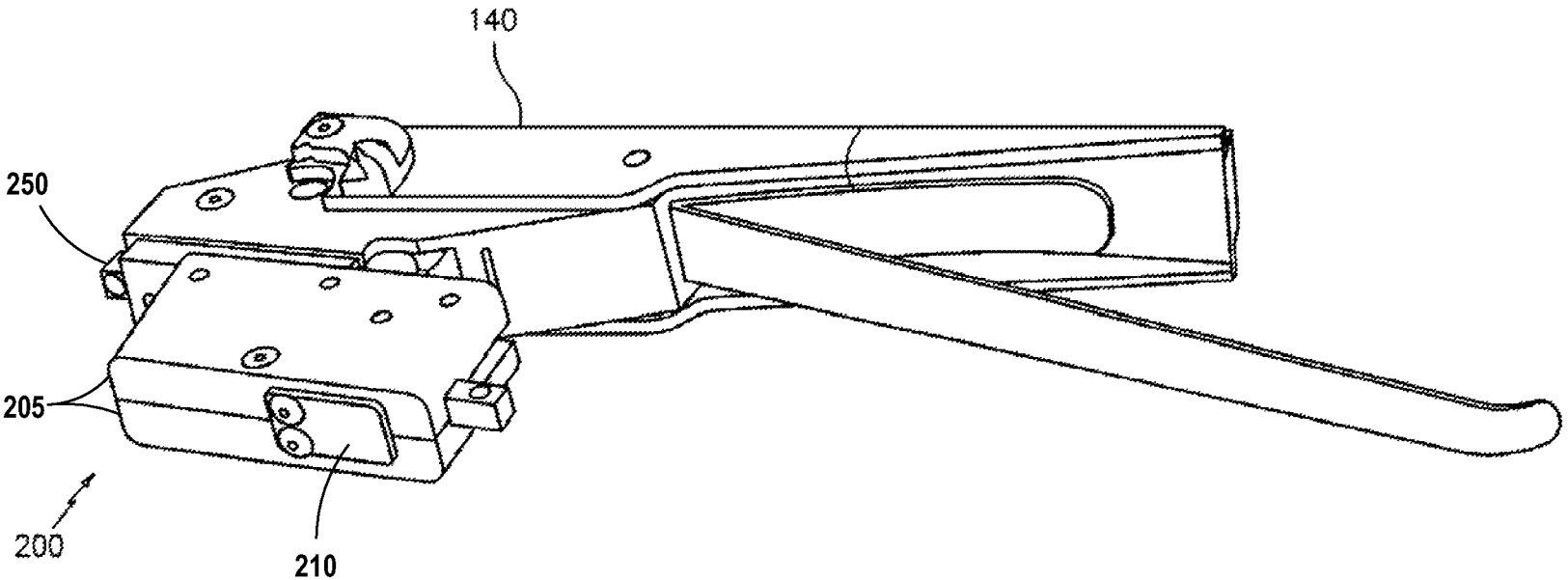
FIG. 16 is a view of dry fire arrestor and a mount for the telescopic sight.

A spring plate 210, shown disassembled from the dry fire arrestor 200 in FIGS. 1 and 2 and assembled in arrestor 200 in FIG. 16, is preferably affixed to each casing half 205 via respective affixing holes 211. The flexibility of the spring plate 210 when affixed to casing halfs 205 upwardly biases the anti-dry fire bar 225. Insertion of the arrow 290 overcomes the upward biasing force, and moves the anti-dry fire bar downward (FIG. 5). FIG. 5 shows the bar 225 in a down position below string slot 256 in casing halfs 205. FIG. 7 shows the bar in an up position with portion 254 extending into slot 256 in the casing halfs.

Figure 3:
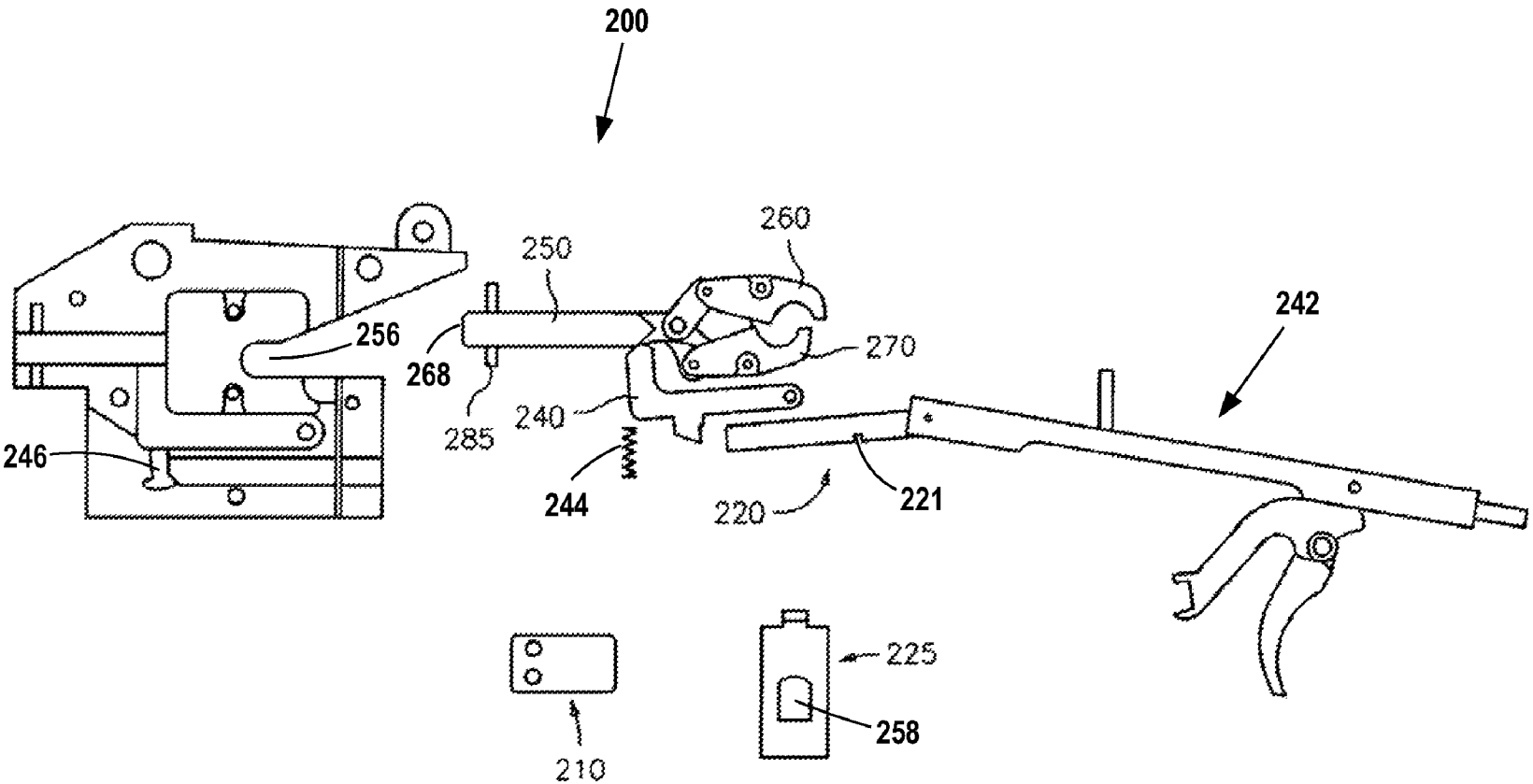
FIG. 3 is a disassembled view of the crossbow dry fire arrestor of FIG. 1, also showing a trigger mechanism.
Figure 4:
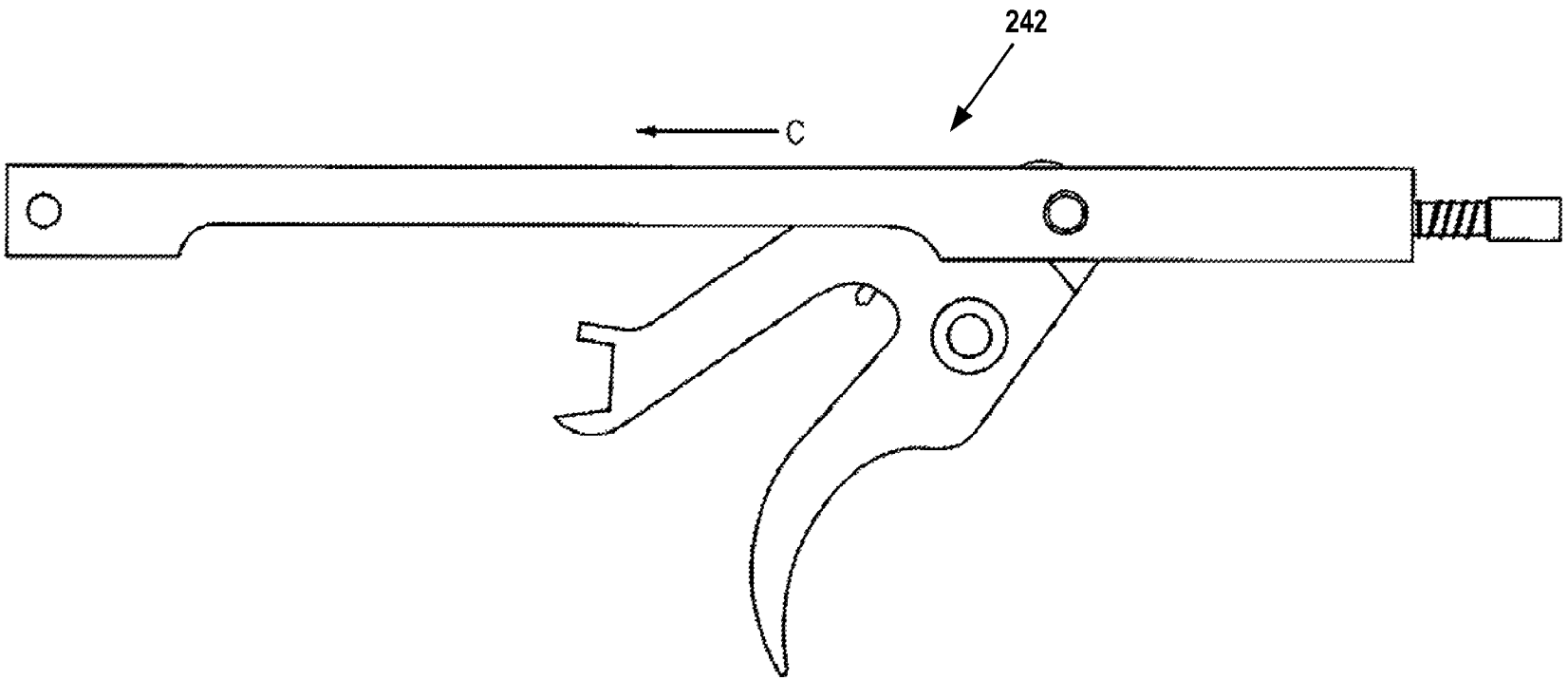
FIG. 4 is a close-up view of a portion of the trigger mechanism of FIG. 3.

FIG. 2 shows the crossbow dry fire arrestor of FIG. 1, with a trigger sear 220 and engaging member 240 further disassembled, and with crossbow string holding jaws removed. The anti-dry fire bar 225 engages and disengages with trigger sear 220, which is connected to a conventional trigger mechanism 242 as shown in FIGS. 3 and 4. The tension provided by spring plate 210 normally holds the bar 225 in the up position and allows anti-dry fire bar 225 to automatically engage trigger sear 225, which precludes any movement of the trigger when an arrow 290 is not properly inserted in the dry fire arrestor 200. The sear 220 extends through opening 258 in bar 225. When the bar is in the up position, the bottom edge of the opening is held in slot 221 in the sear to prevent movement of the sear. This automatic immobilizing of the trigger mechanism 242 acts in addition to a conventional thumb safety lock. In the present invention, pressure of the crossbow string neither activates nor precludes operation of the anti-dry fire mechanism 200.

Pulling the crossbow trigger exerts a forward motion ("A" in FIG. 1) on trigger sear 220, which abuts a shoulder region 245 of engaging member 240. As shown in FIG. 2, shoulder region 245 protrudes slightly below the otherwise flat bottom surface of jaw urging member 240.

Figure 6:
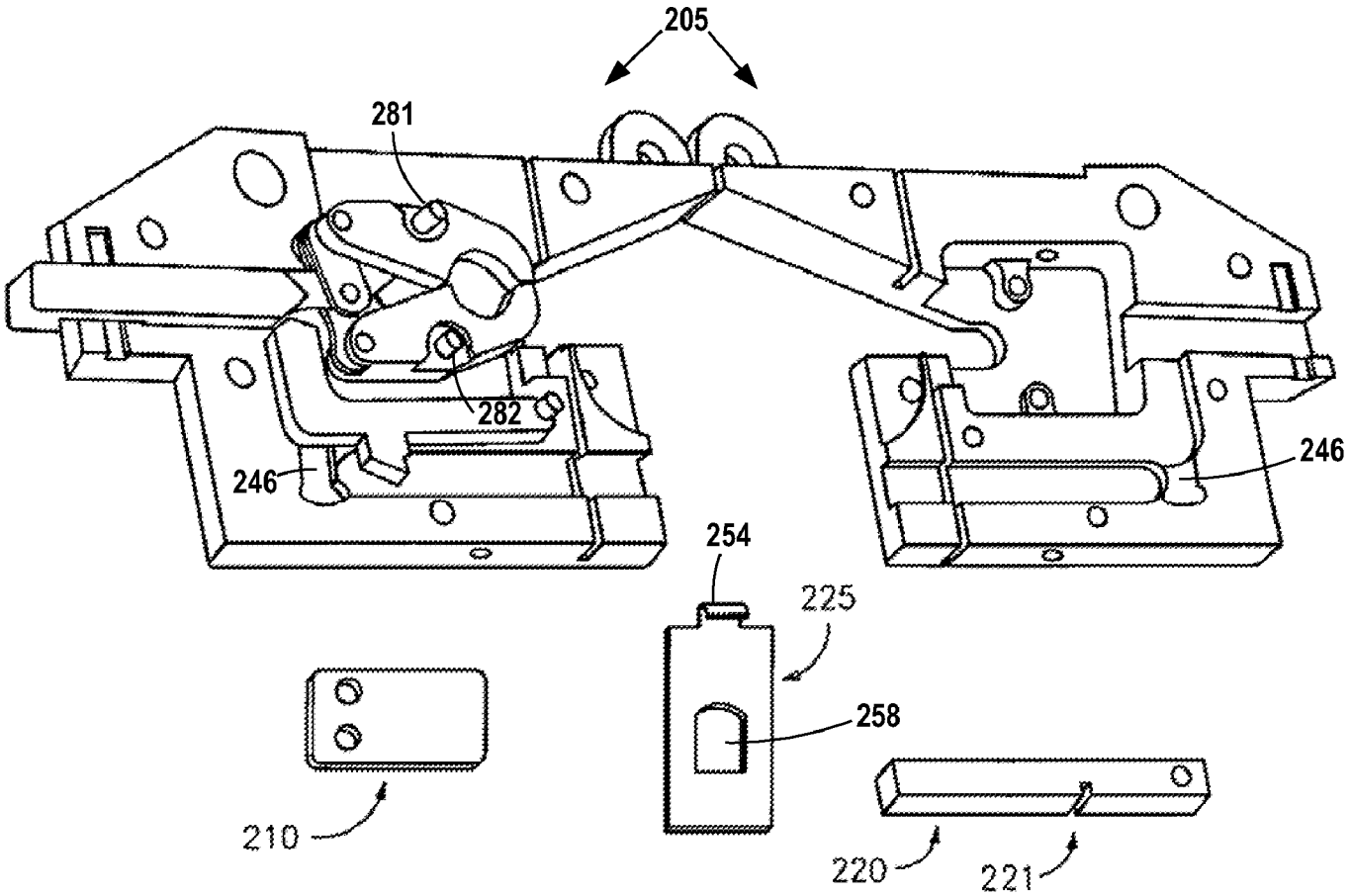
FIG. 6 is a disassembled view showing details of a slot of a trigger sear for engagement of the anti-dry fire bar.

Hole or opening 258 in the anti-dry fire bar 225 through which trigger sear 220 passes is shown in FIGS. 2 and 6. Trigger sear 220 is provided with slot 221 that engages a lower edge of the hole or opening when an arrow 290 is not properly inserted in the dry fire arrestor 200. Engagement of the anti-dry fire bar 225 with the slot 221 of trigger sear 220 precludes any movement of the trigger sear 220. FIG. 7 provides a disassembled view of the crossbow dry fire arrestor of FIG. 1, showing engagement of the sear 220 with the shoulder region 245 of engaging member 240, with spring plate 210 removed, to allow the anti-dry fire bar 225 to protrude below the casing 205, which will allow the jaws to remain in the cocked position. In this position, the upper corner 262 of the inner end 264 of the sear 220 in step or notch 266 in the adjacent face of region 245 on engaging or lock member 240.

Proper insertion of the arrow pushes the anti-dry fire bar 225 downward against spring 210, thereby freeing and allowing the trigger sear 220 to move forward and move corner 262 out of engagement with step 266. Forward movement of the trigger sear 220 permits the engaging member 240 to drop, thereby allowing jaw urging member 250 (not shown in FIG. 7) to move forward, resulting in upper and lower jaws 260, 270 opening via rotation about first and second jaw fulcrum posts 281, 282.

Figure 10:
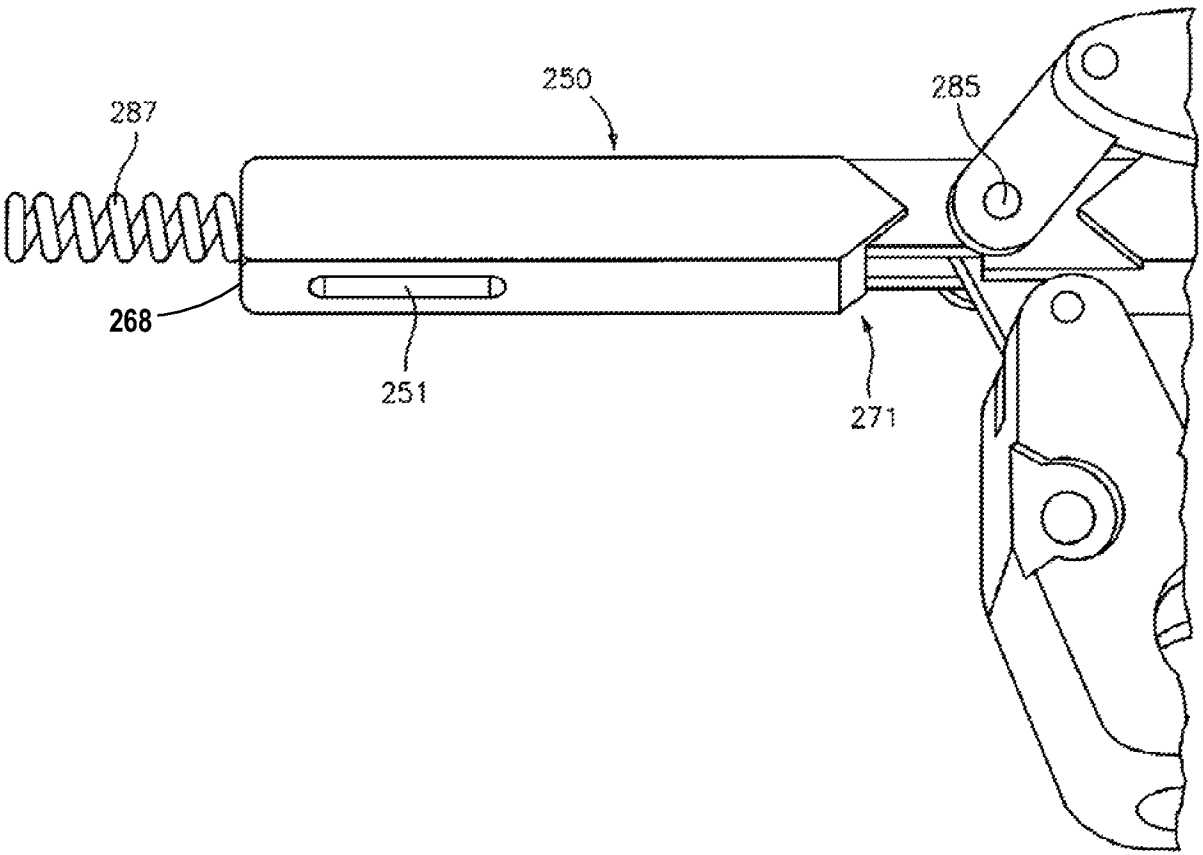
FIG. 10 is a side view of the jaw urging member.
Figure 11:
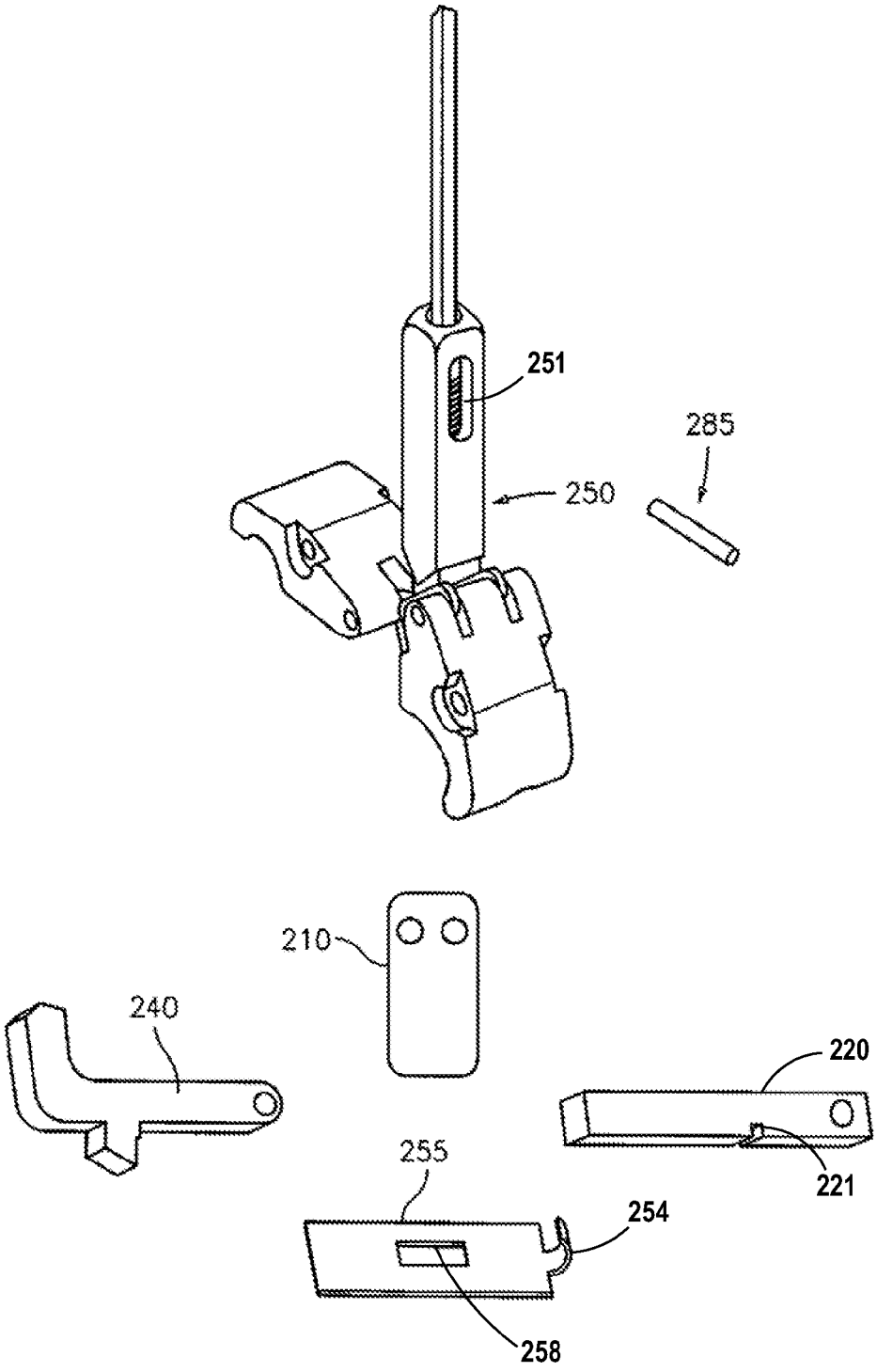
FIG. 11 shows compression of the jaw spring into its containment cavity and other components.

To provide opening/closing force for operation of the upper and lower jaws 260, 270, a jaw post 285 is provided in post groove 286 to hold, jaw spring 287 in a compressed state within a containment cavity 288 in the inner end of jaw urging member 250. For clarity, FIG. 1 shows jaw post 285 removed but positioned near the post groove 286 in casing 205. FIG. 9 provides a top view of the jaws, showing jaw urging member 50 and containment cavity 288. Access to the containment cavity 288 is provided via a jaw member slot 251 shown in FIGS. 9 and 10, through which the jaw post 285 passes (see FIG. 3), and via a distal or inner end 268 (FIGS. 2 and 11) of jaw urging member 250. FIG. 10 provides a side view of the jaw urging member 250, showing jaw spring 287 protruding from its containment cavity via the distal end of jaw urging member 250, and FIG. 11 shows compression of the jaw spring 287 into its containment cavity for insertion of jaw post 285 through jaw member slot 251.

Figure 12:
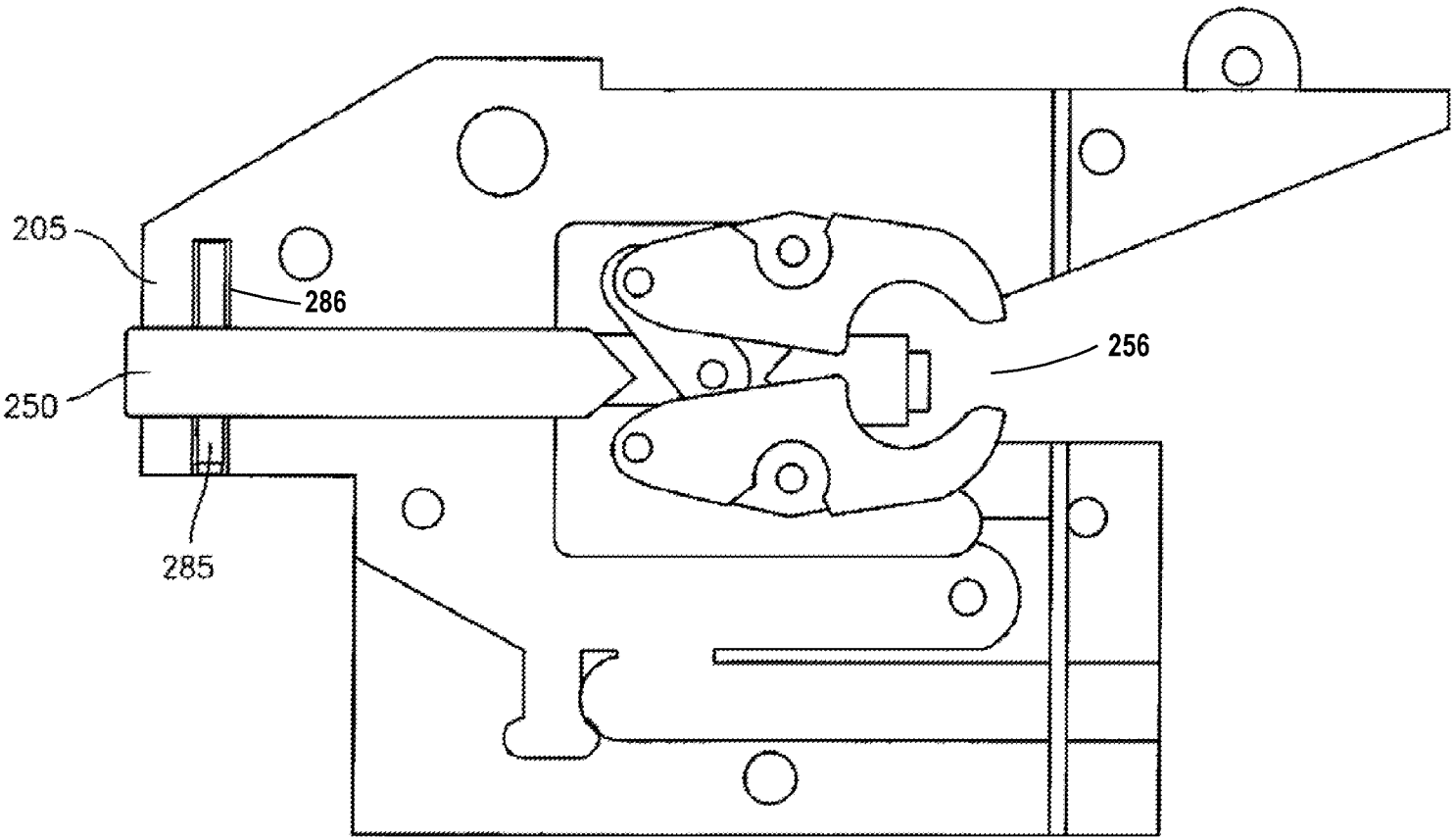
FIG. 12 shows a partially assembled dry fire arrestor.
Figure 13:
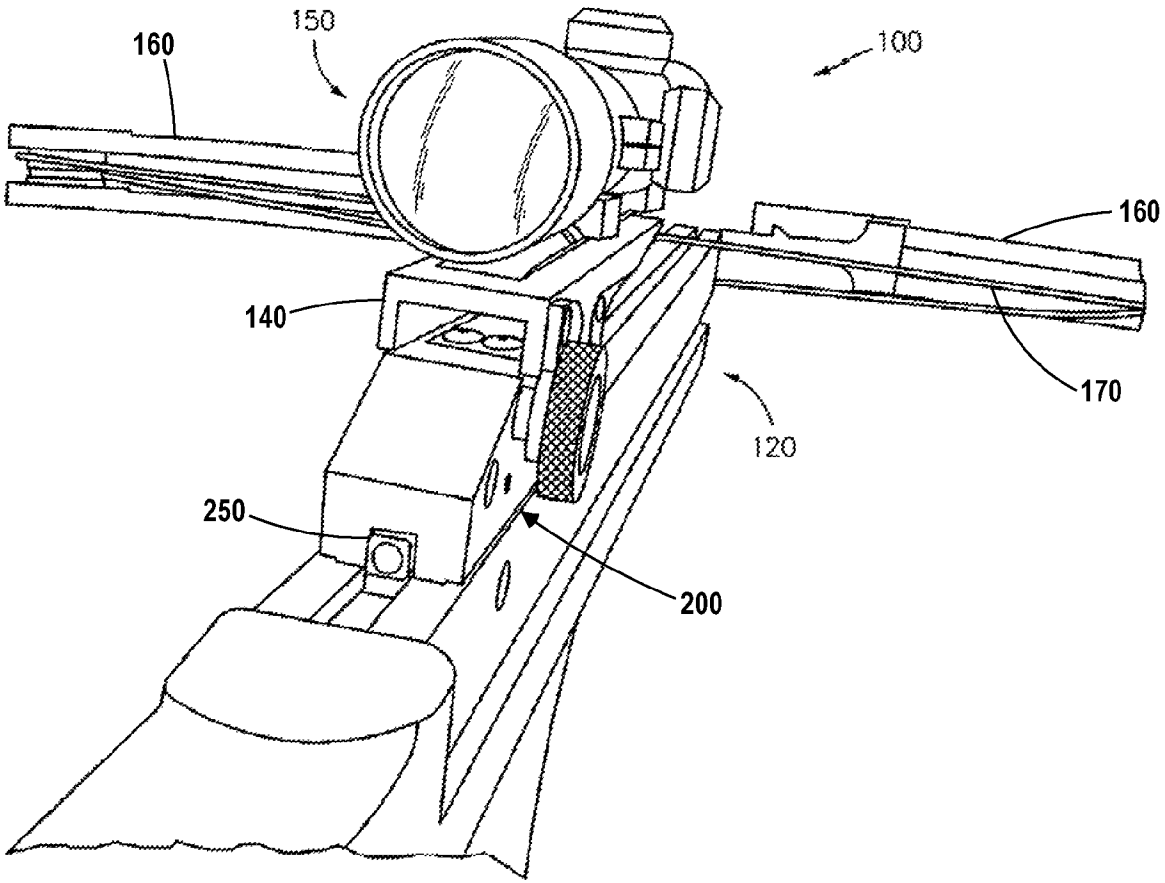
FIG. 13 is a perspective view of a crossbow with a dry fire arrestor and a telescopic sight.
Figure 14:
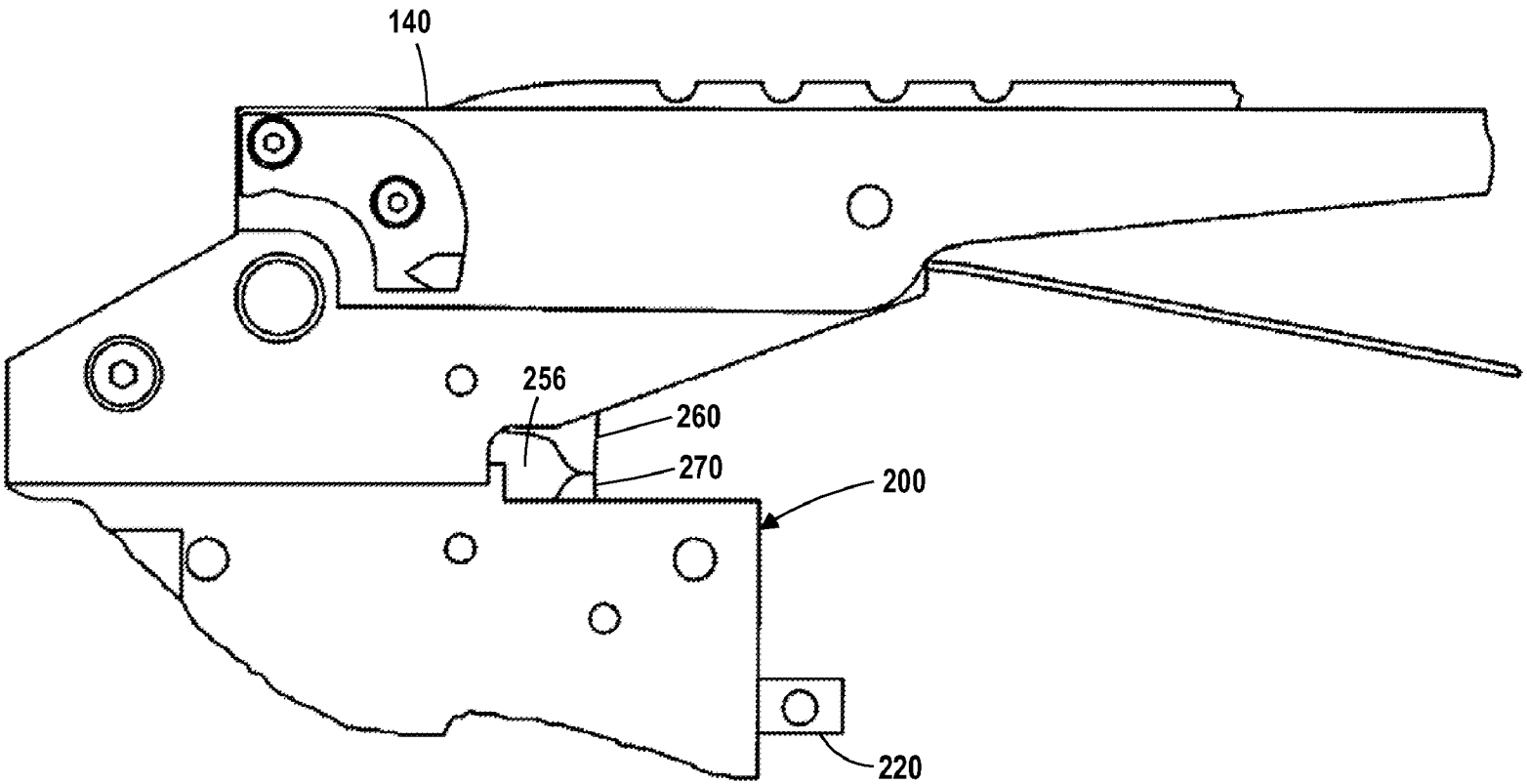
FIG. 14 is a side view of the crossbow with a telescopic sight, partially broken away.
Figure 15:
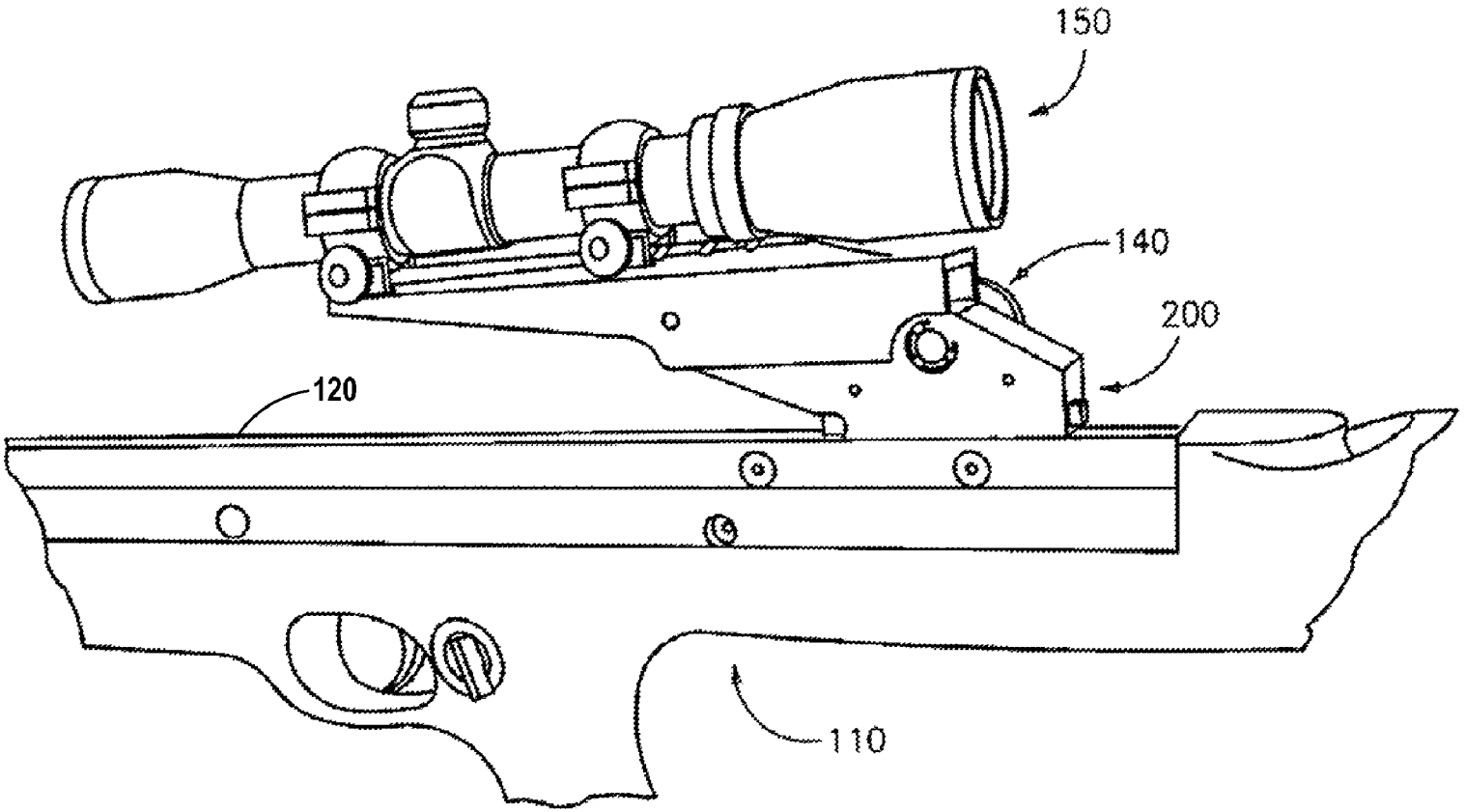
FIG. 15 is a side view of the crossbow taken from the side opposite the side shown in FIG. 14.

As shown in FIGS. 8-12, compression of jaw spring 287 in containment cavity 288 creates a tension force against jaw pin 285. FIG. 12 depicts the normally open position of upper and lower jaws 250, 270, awaiting insertion of the crossbow string, which pushes forward edges of the upper and lower jaws apart, creating a rotation force about first and second jaw fulcrum pins 281 and 282 (FIGS. 1 and 7) and pushing the jaw urging member 250 in a rearward direction (arrow "C" of FIG. 1). The jaw spring 287 force opposes such rearward pushing of jaw urging member 250. Rearward movement of member 250 closes jaws 260 and 270 on the crossbow string and moves the member to the position of FIG. 1. Spring 244 is fitted in recess 246 and holds member 240 in the position of FIG. 1 for engagement with sear 220. The sear holds member 250 against release until an arrow is loaded in the crossbow to move bar 225 down and out of slot 221 and free the sear for movement when the trigger is pulled.

What is claimed is:

1. A dry fire arrestor for a crossbow having a trigger mechanism operable to fire an arrow or bolt, the dry fire arrestor comprising:

upper and lower jaws for holding a crossbow string;

an arrow or bolt inserted between the upper and lower jaws;

a spring plate;

a trigger sear connected to the trigger mechanism; and an anti-dry fire bar for engaging and disengaging the trigger sear, the spring plate biasing the anti-dry fire bar to engage the trigger sear and prevent trigger operation;

wherein insertion of an arrow or bolt between the jaws moves the anti-dry fire bar, disengaging the trigger sear and allowing trigger operation.

2. The dry fire arrestor of claim 1, wherein an opening is provided between the upper and lower jaws through which the arrow or bolt is inserted.

3. The dry fire arrestor of claim 1, wherein said spring plate biases the anti-dry fire bar upwardly to engage the trigger sear.

4. The dry fire arrestor of claim 1, wherein the upper and lower jaws hold a crossbow string at a position not contacting a barrel of the crossbow.

5. The dry fire arrestor of claim 1, wherein the pressure of a crossbow string on the jaws neither activates nor precludes operation of the anti-dry fire mechanism.

6. A dry fire arrestor for a crossbow having a trigger mechanism operable to fire an arrow or bolt, the dry fire arrestor comprising:

a string holder including a first jaw;

an arrow or bolt in the string holder;

a spring;

the trigger mechanism connected to a trigger sear; and an anti-dry fire member, the spring biasing the anti-dry fire member to engage the trigger sear and prevent trigger operation;

wherein insertion of the arrow or bolt into the string holder moves the anti-dry fire member to disengage the trigger sear and allow trigger operation.

7. The dry fire arrestor of claim 6 wherein the string holder includes a second jaw, the arrow or bolt inserted between the first and second jaws.

8. The dry fire arrestor of claim 7 wherein an opening is provided between the first and second jaws through which the arrow or bolt is inserted.

9. The dry fire arrestor as in claim 7 wherein the upper and lower jaws hold a crossbow string at a position not contacting a barrel of the crossbow.

10. The dry fire arrestor of claim 7 wherein the pressure of a crossbow string on the jaws neither activates nor precludes operation of the anti-dry fire mechanism.

11. The dry fire arrestor as in claim 6 wherein the spring biases the anti-dry fire member upwardly to engage the trigger sear.

12. The dry fire arrestor of claim 6 wherein the sear extends through an opening in the anti-dry fire member.

13. The dry fire arrestor of claim 6 wherein the spring comprises a plate.

14. The dry fire arrestor of claim 6 wherein part of the anti-dry fire member extends into the sear when the anti-dry fire member prevents trigger operation.

15. A dry fire arrestor for a crossbow having a trigger mechanism operable to fire an arrow or bolt, the dry fire arrestor comprising:

a string holder, the string holder operable to hold a tensioned crossbow string for release to fire an arrow or bolt;

an arrow or bolt inserted in the crossbow to engage a tensioned crossbow string held by the string holder;

a trigger sear connected to the trigger mechanism;

a shiftable anti-dry fire member for engaging and disengaging the trigger sear to prevent and allow trigger operation;

a spring biasing the anti-dry fire member to engage the trigger sear and prevent trigger operation;

the anti-dry fire member including a portion contacted by an arrow or bolt inserted into the crossbow to shift the anti-dry fire member out of engagement with the trigger sear;

wherein insertion of the arrow or bolt into the crossbow to engage the string shifts the anti-dry fire member, disengages the anti-dry fire member from the trigger sear and allows trigger operation.

16. The dry fire arrestor of claim 15 wherein the string holder comprises a jaw.

17. The dry fire arrestor as in claim 15 wherein the anti-dry fire member extends into the sear when the anti-dry fire member prevents trigger operation.

18. The dry fire arrestor as in claim 15 wherein the portion of the anti-dry fire member is rounded.

19. The dry fire arrestor as in claim 15 wherein the anti-dry fire member comprises a bar.

20. The dry fire arrestor as in claim 15 wherein the sear extends through an opening in the anti-dry fire member.

21. A dry fire arrestor for a crossbow comprising:

a trigger mechanism operable to fire an arrow or bolt;

a pair of jaws for holding a tensioned crossbow string, said jaws defining an opening for receiving a portion of the arrow or a bolt;

a spring;

a trigger sear connected to the trigger mechanism; and an anti-dry fire bar for engaging and disengaging the trigger sear, the spring biasing the anti-dry fire bar to engage the trigger sear and prevent trigger operation;

wherein when the arrow or bolt is moved to a firing position in the opening, the arrow or bolt engages and moves the anti-dry fire bar out of engagement with the trigger sear to allow trigger operation.

* * * * *